US007037391B2

(12) United States Patent
Lumley et al.

(10) Patent No.: US 7,037,391 B2
(45) **Date of Patent: *May 2, 2006**

(54) HEAT TREATMENT OF AGE HARDENABLE ALUMINIUM ALLOYS UTILIZING SECONDARY PRECIPITATION

(75) Inventors: Roger Neil Lumley, Clayton South (AU); Ian James Polmear, Mont Albert North (AU); Allan James Morton, Glen Iris (AU)

(73) Assignee: Commonwealth Scientific and Industrial Research Organization, Australian Capital Territory (AU)

( * ) Notice: Subject to any disclaimer, the term of this patent is extended or adjusted under 35 U.S.C. 154(b) by 0 days.

This patent is subject to a terminal disclaimer.

(21) Appl. No.: 10/654,268

(22) Filed: Sep. 3, 2003

(65) Prior Publication Data

US 2005/0076977 A1 Apr. 14, 2005

Related U.S. Application Data

(63) Continuation of application No. PCT/AU02/00234, filed on Mar. 4, 2002.

(30) Foreign Application Priority Data

Mar. 8, 2001 (AU) ..... PR3608

(51) Int. Cl.
*C22F 1/04* (2006.01)

(52) U.S. Cl. ..... 148/698; 148/693; 148/694

(58) Field of Classification Search ..... 148/690, 148/693, 694, 697–702
See application file for complete search history.

(56) References Cited

U.S. PATENT DOCUMENTS 5,076,859 A 12/1991 Rioja et al. ..... 148/12.7
5,108,520 A 4/1992 Liu et al. ..... 148/12.7

(Continued)

FOREIGN PATENT DOCUMENTS

JP 59226197 12/1994

(Continued)

OTHER PUBLICATIONS

"Aluminum and Aluminum Alloys" ASM International, 1993, pp. 290, 293,300,309,314.*

(Continued)

*Primary Examiner*—George Wyszomierski
*Assistant Examiner*—Janelle Morillo
(74) *Attorney, Agent, or Firm*—Ladas & Parry LLP

(57) ABSTRACT

The process is for ageing heat treatment of an age-hardenable aluminium alloy which has alloying elements in solid solution. The process includes holding the alloy at an elevated ageing temperature which is appropriate for ageing the alloy to promote precipitation of at least one solute element, herein termed "primary precipitation" for a period of time which is short relative to a T6 temper. Resultant underaged alloy then is cooled from the ageing temperature to a lower temperature and at a sufficiently rapid rate to substantially arrest the primary precipitation. The cooled alloy then is exposed to an ageing temperature, lower than the elevated ageing temperature for primary precipitation, so as to develop adequate mechanical properties as a function of time, by further solute element precipitation, herein termed "secondary precipitation".

23 Claims, 8 Drawing Sheets

U.S. PATENT DOCUMENTS

| | | | | |
|---|---|---|---|---|
| 5,340,418 | A * | 8/1994 | Wei | 148/549 |
| 5,690,758 | A * | 11/1997 | Oh et al. | 148/700 |
| 5,858,134 | A | 1/1999 | Bechet et al. | |
| 5,879,481 | A | 3/1999 | Price | |
| 6,451,185 | B1 * | 9/2002 | Beier et al. | 204/298.12 |
| 2002/0017344 | A1 * | 2/2002 | Gupta et al. | 148/551 |
| 2003/0041934 | A1 * | 3/2003 | Lumley et al. | 148/698 |

FOREIGN PATENT DOCUMENTS

| | | |
|---|---|---|
| SU | 933789 | 6/1982 |
| TW | 297839 | 5/1984 |
| WO | 87/00206 | 1/1987 |
| WO | 92/18658 | 10/1992 |
| WO | 95/24514 | 9/1995 |
| WO | 96/18752 | 6/1996 |
| WO | 01/48259 A1 | 7/2001 |

OTHER PUBLICATIONS

"ASM Handbook: vol. 4 Heat Treating", ASM International, 1991, p. 845-850.*

Derwent Abstract Accession No. 85-033647/06 of JP 59226197 dated Dec. 19, 1994.

English Translation of SU 933789 dated Jun. 7, 1982, Abstract.

Pashley, D.W., et al. "Delayed Ageing in Aluminum-Magnesium-Silicon Alloys: Effect on Structure and Mechanical Properties." *Journal of the Institute of Metals* (1966) vol. 94 pp. 41-49.

Gerlach, R. and H. Löffler. Development of the Microhardness of an AL-2.0 at % Zn-1.3 at % Mg Alloy with Additions of Technical Impurities during a Two-step Ageing Treatment (II). *Crystal Res. & Technol.* (1982) 17(2) pp. 267-273.

Bartuska, P. et al. "On the Room Temperature Stability of Metastable Phases Formed at 200° C. in Al-Zn Alloys." *Phys. Stat. Sol,* (1979) 55, pp. 673-679.

Löffler, H. et al. "Decomposition processes in AL-Zn-Mg Alloys." *Journal of Materials Science*, (1983) 18, pp. 2215-2240.

Wendrock, G. and H. Löffler. "Two-Step Ageing Treatments as a Means to Estimate the Zinc Content of Guiniar-Preston Zones at Elevated Temperatures in an AI-15 at %Zn Alloy." *Phys. Stat. Sol.*, (1985) 90, pp. 483-487.

Löffler, Hans. "Sequence of Phases during Isothermal Ageing", Chapter 3, pp. 250-266, References, pp. 475-481. *Structure and Structure Development of AI-Zn Alloys*. Akademic Verlag GmbH, Berlin (1995).

Pashley, D.W. et al. "The Basic Processes Affecting Two-Step Ageing in an Al-Mg-Si Alloy." *Philosophical Magazine*, (1967) pp. 51-76.

English translation of Taiwan Patent No. 297839 dated May 2, 1984, abstract.

"Aluminum Standards and Data 1998 Metric Sl", The Aluminum Association. Apr. 1998. pp. 3-12 to 3-17.

"International Alloy Designations and Chemical Composition Limits for Wrought Aluminum and Wrought Aluminum Alloys." *Unified North American and International Registration Records, The Aluminum Association*. Jul. 1998.

Silcock, J.M. et al. "Structural Ageing Characteristics of Binary Aluminum-Copper Alloys." *J. Institute of Metals*. (1953), 82: 239-248.

Lumley, R. N. et al. "Control of Secondary Precipitation to improve the Performance of Aluminum Alloys." *Materials Science Forum*, (2002), vols. 396-402, pp. 893-898. Copyright 2002, Trans Tech Publications, Switzerland.

Altenpohl, Dietrich G. *Aluminum: Technology, Applications, and Environment. A Profile of a Modern Metal*. Sixth Edition. 1998. The Aluminum Association, Washington, D.C. and The Minerals, Metals & Materials Society, Warrendale, Pennsylvania. pp. 220-224.

Light Alloys, Metallurgy of the light metals. third edition: I.J. Polmear: table of contents: pp. 79, 81, 83, and 85.

Enhanced creep performance in an A l-Cu-Mg-Ag alloy through underageing: R.N. Lumley, A.J. Morton, I.J. Polmear: Acta Materialia 50 (2002) 3597-3608.

Temper Developments Using Secondary Ageing: R.N. Lunley, I.J. Polmear, A.J. Morton : Aluminum Alloys, Institute of Minerals Engineering Australasia, Aug. 2-5, 2004.

* cited by examiner

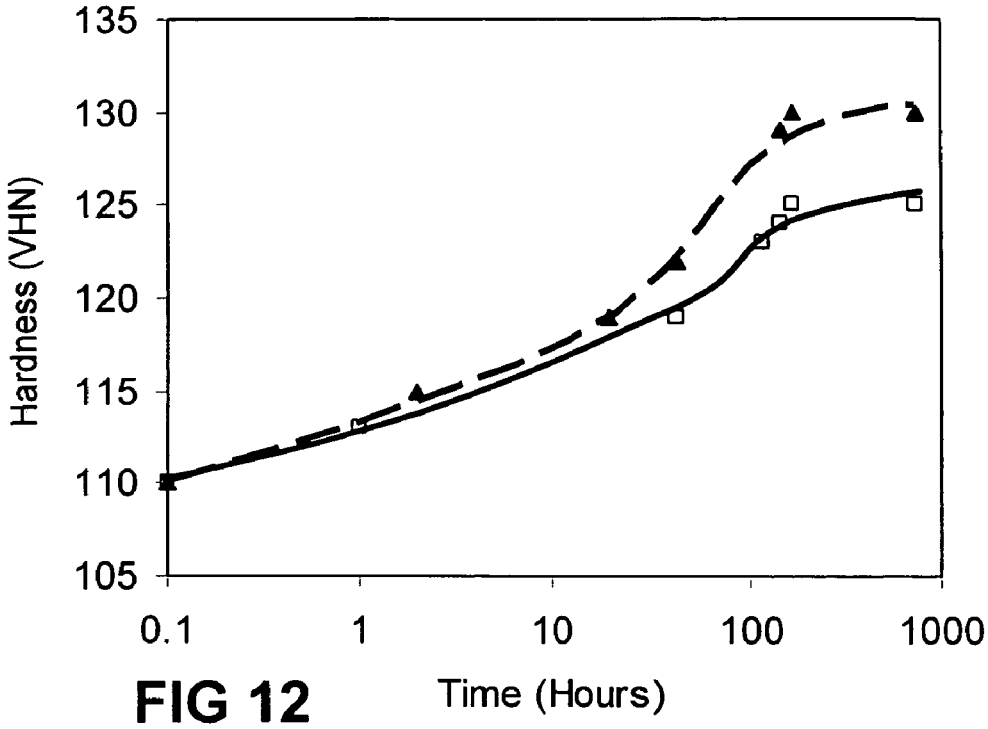
FIG 12
FIG 13
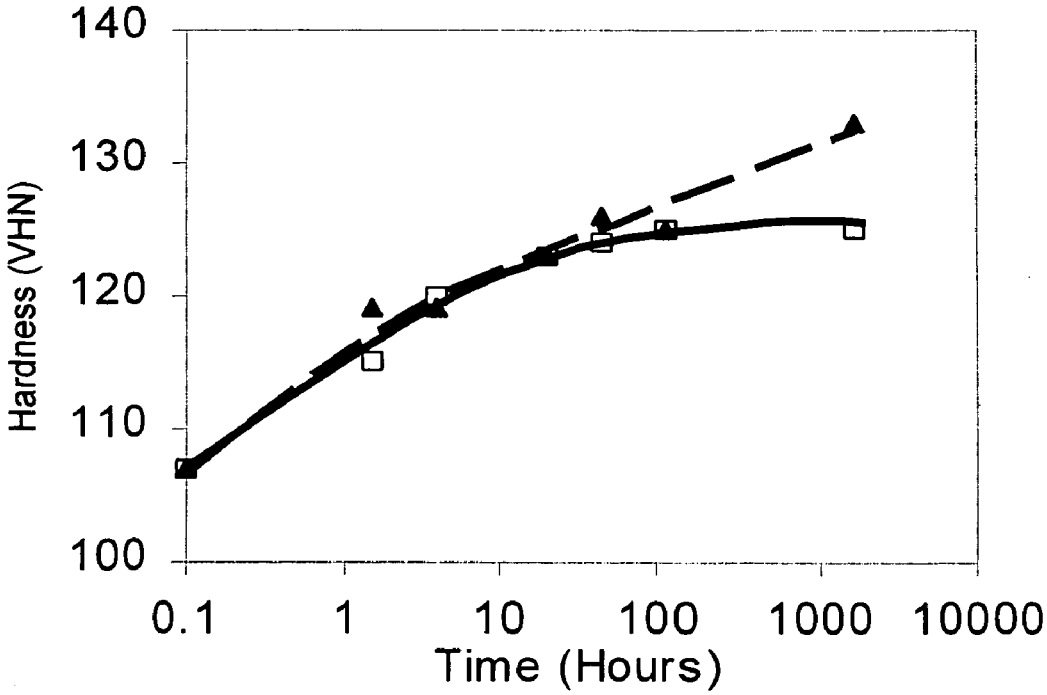

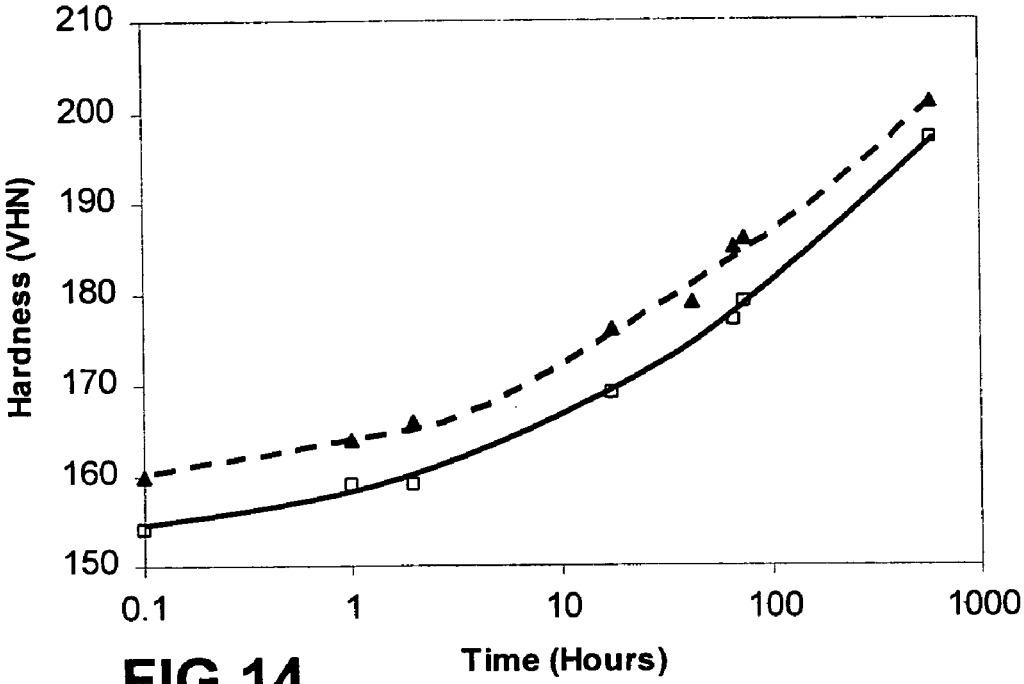
FIG 14
FIG 15
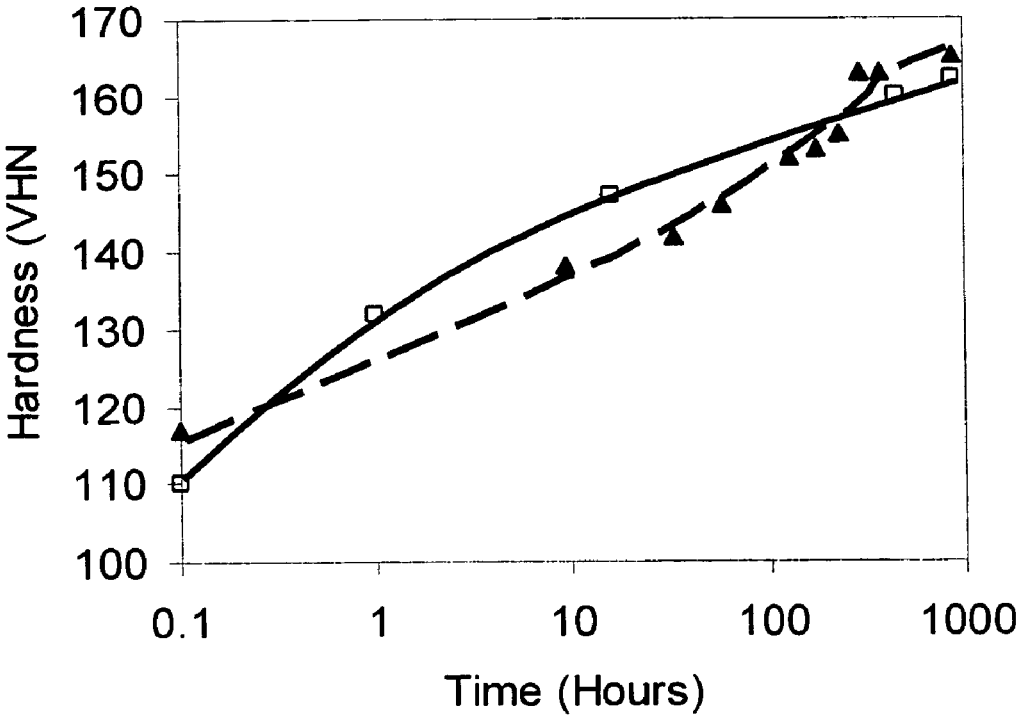

HEAT TREATMENT OF AGE HARDENABLE ALUMINIUM ALLOYS UTILIZING SECONDARY PRECIPITATION

This application is a continuation of copending International Application PCT/AU02/00234 filed on 4 Mar. 2002, which designated the U.S., claims the benefit thereof and incorporates the same by reference.

This invention relates to the heat treatment of aluminium alloys that are able to be strengthened by the well known phenomenon of age (or precipitation) hardening.

Heat treatment for strengthening by age hardening is applicable to alloys in which the solid solubility of at least one alloying element decreases with decreasing temperature. Relevant aluminium alloys include some series of wrought alloys, principally those of the 2000 (Al—Cu, Al—Cu—Mg), 6000 (Al—Mg—Si) and 7000 (Al—Zn—Mg) series of the International Alloy Designation System (IADS). Additionally, many castable alloys are age hardenable. The present invention extends to all such aluminium alloys, including wrought and castable alloys as well as metal matrix composites, powder metallurgy products and products produced by unconventional methods such as rapid solidification.

Heat treatment of age hardenable materials usually involves the following three stages:

1. Solution treatment at a relatively high temperature to produce a single phase solid solution, to dissolve alloying elements;
2. Rapid cooling, or quenching, such as into cold water, to retain the solute elements in super saturated solid solution; and
3. Ageing the alloy by holding it for a period at one, sometimes at a second, intermediate temperature to achieve hardening or strengthening.

The strengthening that results from such ageing occurs because the solute retained in the supersaturated solid solution forms precipitates, as part of an equilibration response, which are finely dispersed throughout the grains and increase the ability of the material to resist deformation by the process of slip. Maximum hardening or strengthening occurs when the ageing treatment leads to the formation of critical dispersions of one or more of these fine precipitates.

Ageing conditions vary for different alloys. Two common treatments which involve only one stage are to hold for an extended time at room temperature (T4 temper) or, more commonly, at an elevated temperature for a shorter time (eg. 8 hours at 150° C.) which corresponds to a maximum in the hardening process (T6 temper). Some alloys are held for a prescribed period of time at room temperature (eg. 24 hours) before applying the T6 temper at an elevated temperature.

In other alloy systems, the solution treated material is deformed by a given percentage before ageing at an elevated temperature. This is known as the T8 temper, and results in an improved distribution of precipitates within the grains. Alloys based on the 7000 series alloys can have two or more stages in their ageing treatment. These alloys can be aged at a lower temperature before ageing at a higher temperature (eg. T73 temper). Alternatively, two such stages can precede a further treatment, where the material is aged further at a lower temperature (sometimes known as retrogression and reageing or RRA).

In a recent proposal for the alloy 8090, the material is aged for a given period at an elevated temperature, followed by short periods at incrementally decreasing temperature stages. This provides a means to develop improved fracture behaviour in service.

In our co-pending International patent application PCT/AU00/01601, there is disclosed a novel three stage age hardening treatment. This describes a process of ageing first for a relatively short period at the normal elevated ageing temperature, followed by an interrupt for a given period at ambient temperature or slightly above, followed finally by further ageing at, or close to the first typical ageing temperature. Such a temper has thus been designated T6I6, signifying the elevated temperature ageing treatment before and after the interrupt step (I). This process is applicable to all age hardenable aluminium alloys, and relies on a secondary precipitation process to instigate low temperature hardening during the interrupt stage (I), then utilising these secondary precipitates to enhance the final response to age hardening at elevated temperature.

Some forms of secondary precipitation may have a deleterious effect on properties, as has been shown with the lithium-containing aluminium alloy 2090 and the magnesium alloy WE54. In these cases the finely dispersed, secondary precipitates that form when these alloys are aged to the T6 condition and then exposed for long times at lower temperatures, for example in the range of about 90° C. to 130° C., may produce unacceptable decreases in ductility and toughness.

The present invention is directed to providing ageing treatments that enable enhanced combinations of mechanical properties to be obtained for many age hardenable aluminium alloys.

The present invention provides a process for the ageing heat treatment of an age-hardenable aluminium alloy which has alloying elements in solid solution, wherein the process includes the stages of:

(a) holding the alloy at an elevated ageing temperature which is appropriate for ageing the alloy to promote precipitation of at least one solute element, herein termed "primary precipitation" for a period of time which is short relative to a T6 temper, to thereby produce underaged alloy;

(b) cooling the underaged alloy from the ageing temperature for stage (a) to a lower temperature and at a sufficiently rapid rate to substantially arrest the primary precipitation; and (c) exposing the cooled alloy produced by stage (b) to an ageing temperature, lower than the ageing temperature of stage (a), so as to develop adequate mechanical properties as a function of time, by further solute element precipitation, herein termed "secondary precipitation".

Under the convention proposed in the above-mentioned PCT/AU00/01601, the temper provided by the process of the present invention is designated T6I4. This denotes that the material is artificially aged for a short period, quickly cooled such as by being quenched with a suitable medium, and then held (interrupted) at a temperature and time sufficient to allow suitable secondary ageing to occur.

We have found that a large proportion of age-hardenable aluminium alloys exhibit a favorable response to such the heat treatment of the present invention. In alloys exhibiting a favourable response, it is possible to attain tensile properties and hardness values approximately equivalent to, and sometimes greater, than those properties produced following a typical T6 temper. The process of the invention also can enable a concurrent improvement to other mechanical properties such as fracture toughness and fatigue resistance.

The enhanced combinations of mechanical properties enabled by the process of the present invention are achieved by controlled secondary precipitation. The enhanced properties are able to be achieved within a reduced time at the artificial ageing temperature when compared to equivalent T6 treatments. It can be possible to achieve tensile properties within normal statistical variability of those for the typical T6 alloy material, or greater, but often with, for example, a notably improved fracture toughness. The time factored benefit of the process relates to a shorter duration of the artificial ageing cycle in which the alloy must be artificially heated. Strengthening then is able to continue more slowly at, or close to, ambient temperature for an indefinite period. The strengthening which occurs during the initial heating for artificial ageing usually results in material meeting the minimum specification for engineering service, although the alloy then can continue to strengthen when stored, transported or used.

The ageing treatments in accordance with the present invention are normally applied to alloys that have first been solution heat treated (eg. at 500° C.) to dissolve solute elements and retain them in a supersaturated solid solution by quenching to close to ambient temperature. Both of these operations may precede stage (a) of the ageing treatment or have previously been applied to alloy as received. That is, the alloy as received for application of stage (a) may already have the alloy elements in solid solution. Alternatively, the process of the invention may further include, prior to stage (a), the stages of:

(i) heating the alloy to a solution treatment temperature for a period of time sufficient to take solute elements of the alloy into solid solution, and (ii) quenching the alloy from the solution treatment temperature to thereby retain the alloy elements in solid solution.

Quenching from the solution treatment temperature may be made directly to the ageing temperature for stage (a), so that reheating from the ambient temperature is avoided, or the quenching may be to a lower temperature, such as ambient temperature. However, alloy with solute elements retained in supersaturated solid solution can result from some casting operations, and the process of the invention also can be applied to such alloy as received. Also the invention applies to alloy in which solute elements are retained in solid solution by press quenching from the solid solution temperature or by cooling of alloy during extrusion from the solution treatment temperature, whether this has been achieved in the alloy as received or is achieved in the process of the invention prior to stage (a).

The temperature and time for the stage (a) ageing treatment usually is selected so as to achieve underageing providing not more than 85%, preferably from 40 to 75%, of the maximum hardness and strength attainable from a conventional T6 temper. Depending on the alloy concerned, this may involve holding for times ranging from a few minutes up to several hours at the stage (a) temperature. Under such conditions, the material is said to be underaged. The period of time at the ageing temperature for stage (a) may be from several minutes to about 8 hours. However, provided it is less than the time for full strengthening, it may be in excess of 8 hours.

Cooling in stage (b) from the stage (a) treatment, may be to a temperature in the range of from about 65° C. to about −10° C. In two practical alternatives, the cooling may be to substantially ambient temperature, or to substantially the ageing temperature for stage (c). The cooling is preferably achieved by quenching into an appropriate medium, which may be water or other suitable fluid, such as a gas or polymer based quenchant, or in a fluidised bed. The purpose of the cooling of stage (b) is principally to arrest the primary precipitation which occurs during stage (a).

For stage (c), appropriate times and temperatures are interrelated. For the purpose of the present invention, stage (c) preferably is to establish conditions whereby aged aluminium alloys may achieve strengths similar to, or greater than those for the respective T6 conditions. Temperatures for stage (c) generally lie within the range of 20 to 90° C., depending on the alloy, but are not restricted to this range. For stage (c), appropriate temperatures and holding times are required for the occurrence of secondary precipitation as detailed above. As a rule, the lower the temperature for stage (c), the longer the time required to achieve the desired combination of mechanical properties. This is not a universal rule however, since there are exceptions.

Stage (c) may be conducted for a period of time which, at the ageing temperature for stage (c), achieves a required level of secondary precipitation. Stage (c) may be conducted for a period which, at its ageing temperature, achieves a required level of strengthening of the alloy beyond the level obtained directly after stage (b). The period may be sufficient to achieve a required level of tensile properties. The level of tensile properties may be equal to, but preferably greater than, that obtainable with a full T6 temper. The period may be sufficient to achieve a combination of a required level of tensile properties and of fracture toughness. The fracture toughness may be at least equal to that obtainable with a full T6 temper.

The process of the present invention is applicable not only to the standard, single stage T6 temper but also applicable to other tempers. These include any such tempers that typically involve retention of solute from higher temperature, so as to facilitate age-hardening. Some examples include (but are not restricted to) the T5 temper, T8 temper and T9 temper. In these cases, the application of the invention is manifest in quenching at a sufficiently rapid rate from the ageing temperature applied specifically to provide underaged material (stage (a) mentioned above); before holding at reduced temperature (stage (c) above). These tempers, following the previously mentioned convention, would be termed T5I4, T8I4 and T9I4, meaning that an underaged version of the T5, T8, or T9 treatment is followed by a dwell period at reduced temperature.

In at least one stage of the process of the invention, the alloy may be subjected to mechanical deformation. The deformation may be before stage (a). Thus, where for example, the alloy undergoes solution treatment and quenching stages (i) and (ii) detailed above before stage (a), as part of the process of the invention, the alloy may be subjected to mechanical deformation between stages (i) and (a), such as during stage (ii) by, for example, press quenching or during extrusion of the alloy. However the alloy may be subjected to mechanical deformation between stages (b) and (c) or during stage (c). In each case, working of the alloy resulting from the deformation is able to further enhance properties of the alloy achievable by means of stages (a) to (c) of the process.

As with stage (c) as indicated above, the temperature and period of time for stage (a) are interrelated. In each case, the period increases with decrease in temperature for a given level of primary precipitation in stage (a) and of secondary precipitation in stage (c). However, the conditions for each of stages (a) and (c) are interrelated in that the level of underageing achieved in stage (a) determines the scope for secondary precipitation in stage (c).

The range of suitable underageing in stage (a) varies with the series to which a given alloy belongs and, at least in part, is chemistry dependent. Also, while it is possible to generalise for the alloys of each series on the appropriate level of underageing, there inevitably are exceptions within each series. However, for alloys of the 2000 series in general, underageing to provide from 50 to 85% of maximum tensile strength and hardness obtainable from a full T6 temper generally is appropriate, at least where the alloy is not subjected to mechanical deformation, such as by cold working. When an alloy of the 2000 series is subjected to such deformation, underageing to a lower level of strengthening can be appropriate, depending on the level of working involved. In contrast, alloys of the 7000 series generally enable short time periods for stage (a), such as several minutes, for attainment of appropriate underageing for providing from 30 to 40% of maximum tensile strength and hardness obtainable from a full T6 temper.

The process of the present invention enables many alloys, such as the casting alloy 357 as well as 6013, 6111, 6056, 6061, 2001, 2214, Al—Cu—Mg—Ag alloy, 7050 and 7075, for example, to achieve equivalent to, or greater than, the level of tensile properties or hardness attained in the equivalent T6 tempers. This may occur by a notably reduced time of artificial ageing, and in the case of the 6000 series alloys, Al—Cu—Mg—Ag, some 7000 series alloys and some casting alloys, can provide a simultaneous improvement in the fracture toughness of the alloy. Therefore, in such instances, the alloys display an improved level of fracture toughness for the equivalent level of tensile properties, but with a notably reduced time at the artificial ageing temperature. This suggests that the improvements facilitated by the process of the present invention apart from providing mechanical property benefits, may also include processing cost benefit. In this context, it is decreased time of artificial ageing enabled by the invention that is relevant, since it provides higher strength at reduced cost and faster process times. For example, in alloy 7050 typical T6 properties are achieved after 24–48 h of artificial ageing time. By the process of the present invention for alloy 7050, the amount of time required at elevated temperature in stage (a) may be as short as 5–10 minutes, prior to stage (b) quenching and then conducting stage (c) at close to ambient temperature. Additionally, the time required for artificial ageing with the invention is able to be reduced to a level in 6000 series alloys, for example, such that it can be accommodated in the paint-bake cycle for automotive body sheet, meaning also that multiple processing stages necessary in current practice may be avoided.

In order that the invention may more readily be understood, description now is directed to the accompanying drawings, in which.

FIG. 12 exhibits the effect of stage (b) cooling rate on the subsequent secondary precipitation response for alloy Al-4Cu, and exhibits the contrasting effect of using either an ethylene glycol based quenchant cooled to −10° C. or quenching into hot water at 65° C.;

FIG. 13 is as for FIG. 12, but for alloy 6013;

FIG. 14 is as for FIG. 12, but for alloy 7075; and

FIG. 15 is as for FIG. 12, but for alloy 8090.

The present invention enables the establishment of conditions whereby aluminium alloys which are capable of age hardening may undergo this additional hardening and/or strengthening at a lower temperature in stage (c) if they are first underaged at a higher temperature in stage (a) for a short time and then cooled in stage (b) such as by being quenched to room temperature. This effect is demonstrated in FIG. 1, which shows the general principles of the T6I4 ageing treatment of the present invention and which is a schematic representation of how secondary precipitation is utilised under the conditions of the process of the present invention for T6I4 processing of age hardenable aluminium alloys.

Figure 1:
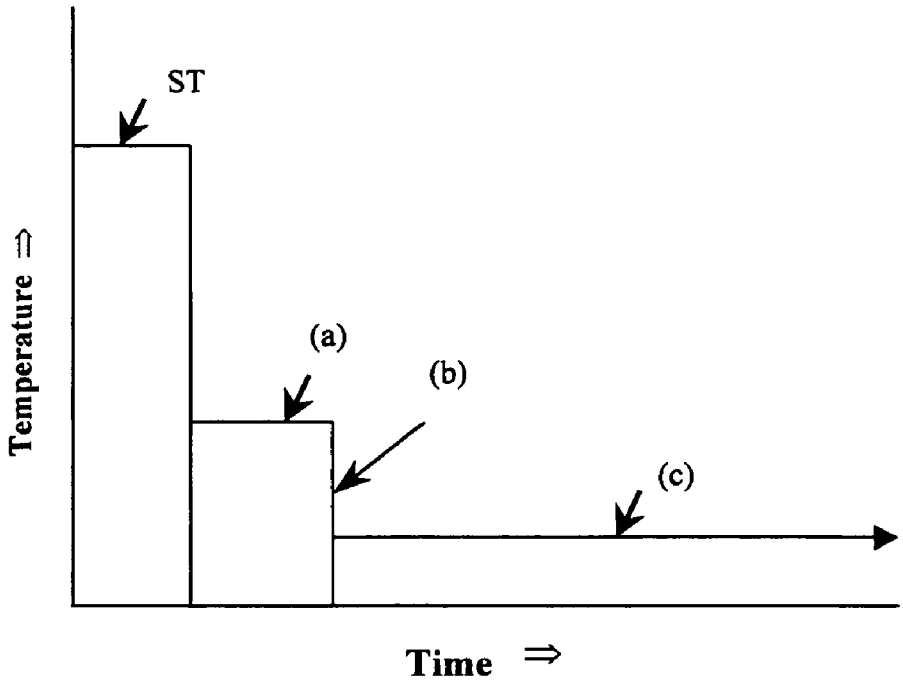
FIG. 1 is a schematic time-temperature graph illustrating an application of the process of the present invention.

As shown in FIG. 1, the T6I4 ageing process utilises successive stages (a) to (c). However, as shown, stage (a) is preceded by a preliminary solution treatment, designated in FIG. 1 as treatment ST, in which the alloy is held at a relatively high initial temperature and for a time sufficient to facilitate solution of alloy elements. The preliminary treatment may have been conducted in the alloy as received, in which case the alloy typically will have been quenched to ambient temperature, as shown, or below ambient temperature. However, in an alternative, the preliminary treatment may be an adjunct to the process of the invention. In that alternative, quenching after treatment ST may be to ambient temperature or below, or it may be to the temperature for stage (a) of the process of the invention, thereby obviating the need to reheat the alloy to the latter temperature.

In stage (a), the alloy is aged at a temperature at or close to a temperature suitable for a T6 temper for the alloy in question. The temperature and duration of stage (a) are sufficient to achieve a required level of underaged strengthening, as described above. From the stage (a) temperature, the alloy is quenched in stage (b) to arrest the primary precipitation ageing in stage (a); with the stage (b) quenching being to a temperature at, or close to, ambient temperature. Following the quenching stage (b), the alloy is maintained at a temperature in stage (c) which is below, typically substantially below the temperature in stage (a), with the temperature at and the duration of stage (c) sufficient to achieve secondary nucleation.

In relation to the schematic representation shown in FIG. 1 of the ageing process and how it is applied to all suitable age hardenable aluminium alloys, the time at temperature in stage (a) is from between a few minutes to several hours, depending on the alloy.

Figure 2:
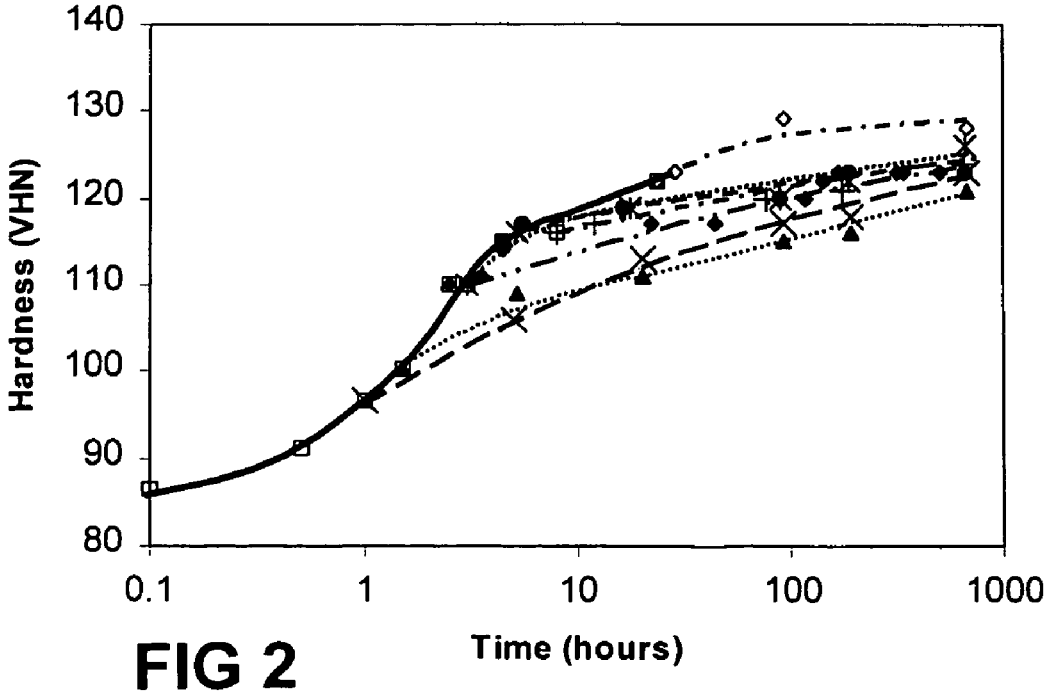
FIG. 2 is a schematic time-temperature graph illustrating secondary precipitation of the experimental alloy Al-4Cu, when aged to different initial times, and illustrating the process of the invention.

FIG. 2 shows the process as applied to hardening of the wrought experimental alloy Al-4Cu. With more specific reference to FIG. 2, the plot therein is of hardness as a function of time and shows the secondary precipitation of alloy Al-4Cu under-aged from different initial times. The alloy was solution treated at 540° C. and then quenched to retain solute elements in solid solution. The stage (a) primary precipitation was then conducted at 150° C., and its course is represented by the solid line. The courses of respective stage (c) secondary precipitations, achieved by holding at 65° C., following the different times for stage (a) are shown by the broken lines and respective stage (c) ageing times of 1, 1.5, 2.5, 3, 4.5, 8 and 24 hours are represented. The full T6 hardness for alloy Al-4Cu aged at 150° C. was found to be 132 VHN. However, as shown by FIG. 2, the alloy undergoes significant secondary precipitation at the lower stage (c) temperature, so that its hardness eventually approaches that gained for the conventionally aged T6 alloy within the timeframe shown.

Figure 3:
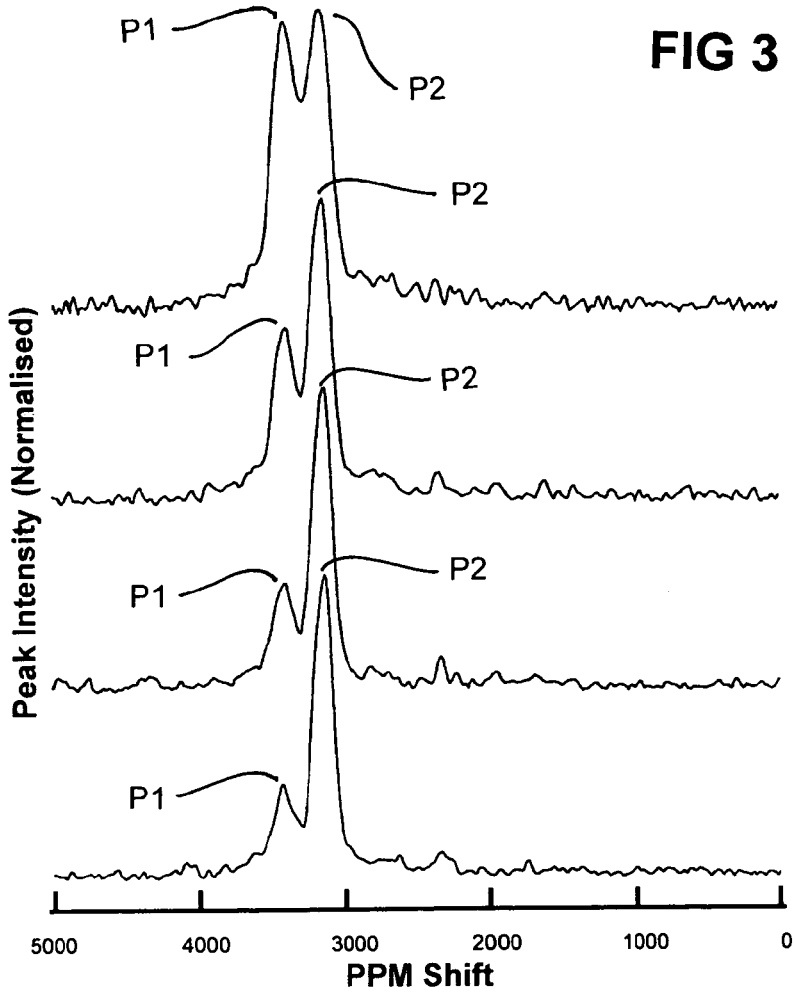
FIG. 3 is a series of Nuclear Magnetic Resonance (NMR) scans A to D, exhibiting the secondary precipitation response for Al-4Cu, as a function of hold time at 65° C.

FIG. 3 shows a series of Nuclear Magnetic Resonance (NMR) scans A to D, exhibiting the secondary precipitation response for alloy Al-4Cu. Scan A exhibits the NMR scan for material that has been solution treated at 540° C., quenched, aged 2.5 h at 150° C., quenched and then immediately tested. Within the scan is shown two distinct peaks, the first of which (Peak P1) corresponds to the intensity of copper atoms that are remaining within the solid solution of the alloy. The second peak, (Peak P2), corresponds to the intensity of copper atoms that are present within the GP1 zones (first order Guinier-Preston zones) in the alloy. GP1 zones are the first nucleated precipitate phase that forms and contributes to strengthening. The peaks of scans A–D have been normalised to the intensity of the GP1 zone peak, so that changes in the concentration of copper in solid solution are most readily observed. Scan A therefore represents material in which the first ageing stage at 150° C. has led to the formation of GP1 zones at this temperature, and have consumed approximately half of the total copper present in the alloy. NMR scans B to D then show the differences in these peaks present after stage (c) hold times, following the stage (b) quench after the under-ageing stage (a), of 240 h (B), 650 h (C) and 1000 h (D) at 65° C., for comparison. Measurement of the respective areas under these peaks shows that the copper retained within solid solution decreases as a function of stage (c) hold time, where the proportion of copper present within GP1 zones increases with stage (c) hold time. By expressing the atomic fraction (1.73At % Cu total) of copper present within GPI zones as a function of hold time, the general shape of the secondary hardening curve may be generated. When this is then compared to the hardness-time curve, as is shown by FIG. 4, the two methods show a high degree of correlation.

Figure 4:
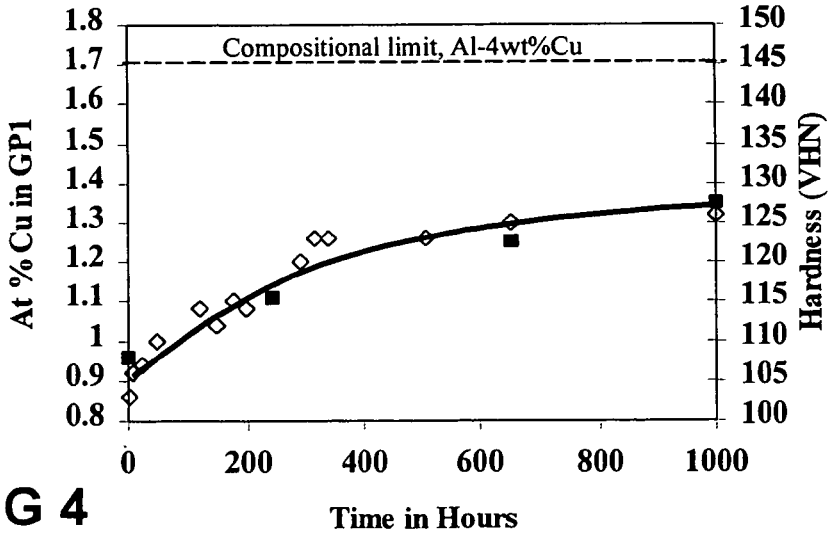
FIG. 4 shows a plot of time against both hardness and atomic % of Cu in GP1 zones for Al-4Cu alloy subjected to heat treatments as detailed for FIG. 3.
Figure 5:
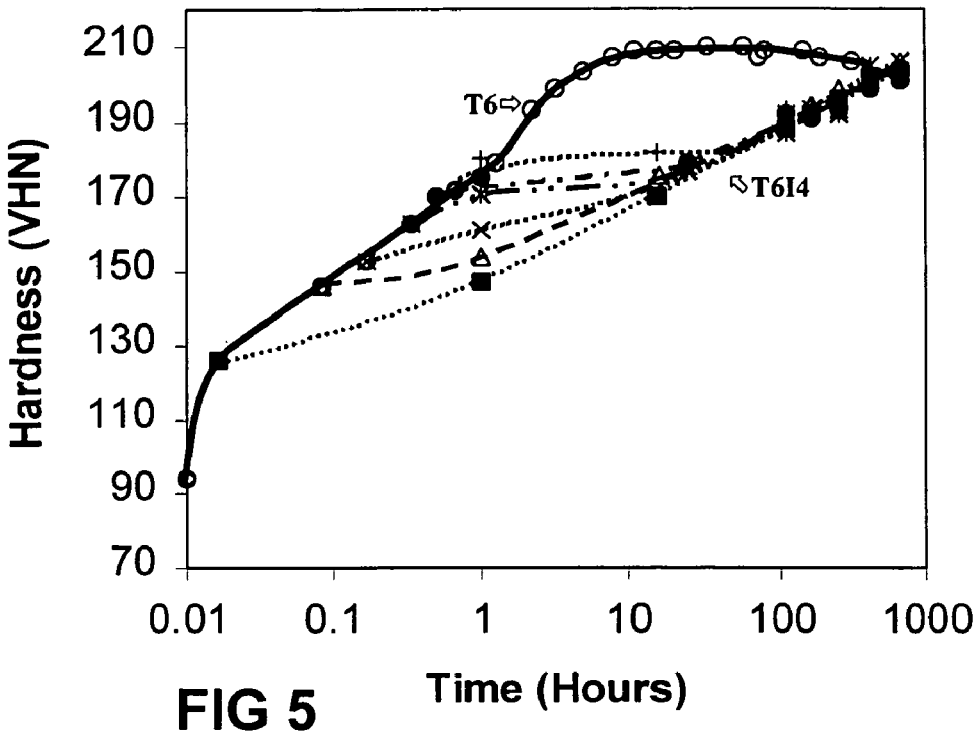
FIG. 5 is a plot of time against hardness, illustrating secondary precipitation response of alloy 7050 in application of the process of the invention, as compared to the T6 temper.

FIG. 4 therefore shows a plot of time against both hardness and atomic % of Cu contained in GP1 zones for Al-4Cu alloy subjected to heat treatments as detailed for FIG. 3;

FIG. 5 shows the process as applied to hardening of the wrought (Al—Zn—Mg—Cu) alloy 7050. With more specific reference to FIG. 5, the plot therein shows the secondary precipitation of alloy 7050 aged from different initial times, compared to the T6 ageing curve for ageing at 130° C. The alloy was solution treated at 485° C. The stage (a) primary precipitation was conducted at 130° C. and its course is represented by the solid line. Following stage (b) quenching, the course of respective stage (c) secondary precipitation from different times for stage (a) are shown by the broken lines (dashed and dotted lines). The full T6 hardness for alloy 7050 aged at 130° C. was found to be 209 VHN. However, as shown by FIG. 5, the alloy undergoes significant secondary precipitation at the lower stage (c) temperature, of 65° C. in this instance, so that its hardness eventually equals that of the T6 temper.

Figure 6:
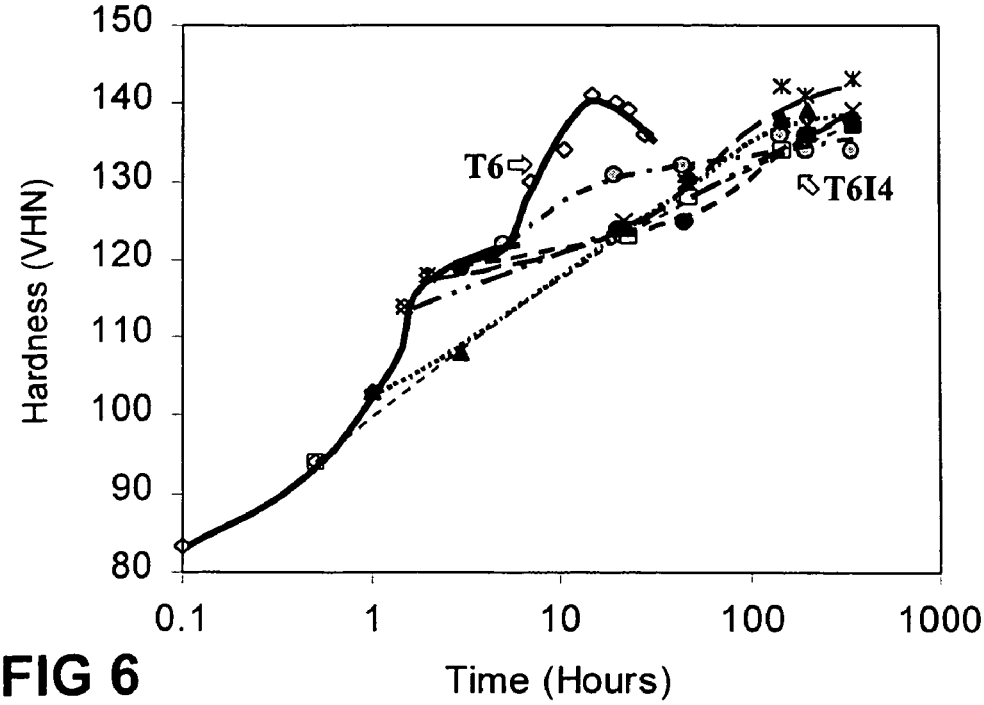
FIG. 6 shows a plot of time against hardness, showing the response in the process of the invention for alloy 2001, as compared to the T6 temper.

FIG. 6 exhibits the process of the present invention as applied to the wrought (Al—Cu—Mg) alloy 2001, and compared to the T6 ageing curve generated at 177° C. The underaged primary precipitation in stage (a) was obtained by heating the alloy at 177° C. The stage (c) secondary precipitation was from different initial times and achieved at 65° C. (broken lines). The peak T6 hardness for alloy 2001 is approximately 140 VHN. For the T6I4 conditions shown in FIG. 6, material initially aged 2 hours typically then hardened to 140 to 143 VHN, that is, equal to or slightly greater than that of the typical T6 alloy. Other initial times of stage (c) underageing display a lesser response to stage (c) secondary hardening, but eventually equalise in the manner shown by FIG. 6.

Figure 7:
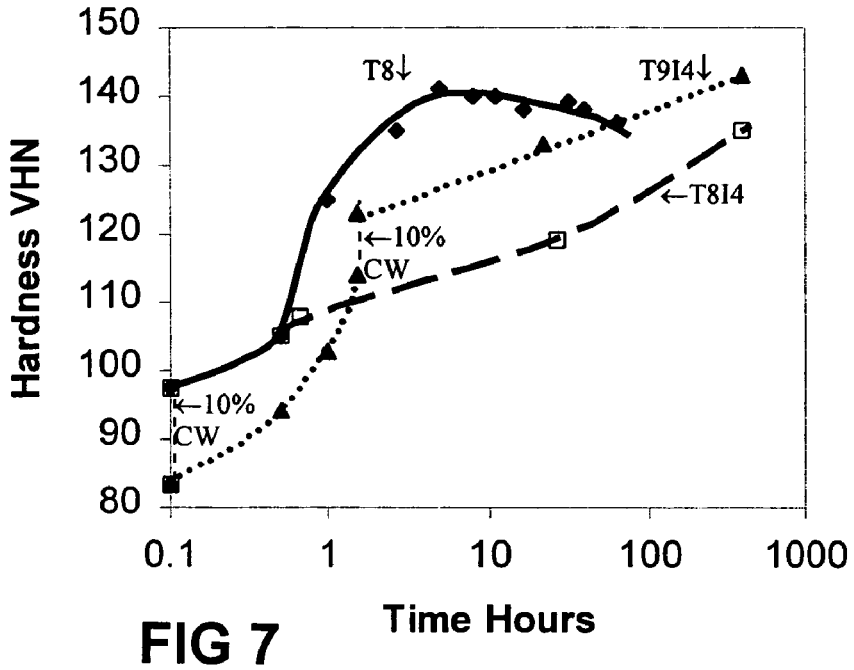
FIG. 7 shows a plot of time against hardness for alloy 2001, showing the response of the process for each of the T8I4 and T9I4 tempers, as compared to the T8 temper.

FIG. 7 exhibits an alternative form of the process of the present invention as applied to the wrought (Al—Cu—Mg) alloy 2001. In this instance, the application is directed at tempers that include a cold working stage. The solid line and diamond markers are for the standard T8 temper, when 10% cold work is applied after solution treatment and prior to ageing at 177° C. The broken line with square markers is a representation of T8I4 ageing, where the alloy was solution treated, quenched, cold worked 10%, aged at 177° C. for 40 minutes and quenched, then held at 65° C. for various times. The broken line with closed triangle markers is for T9I4 ageing, where the alloy was solution treated, quenched, aged at 177° C. for 2 hours, quenched, cold worked 10%, then held at 65° C. for various times.

Figure 8:
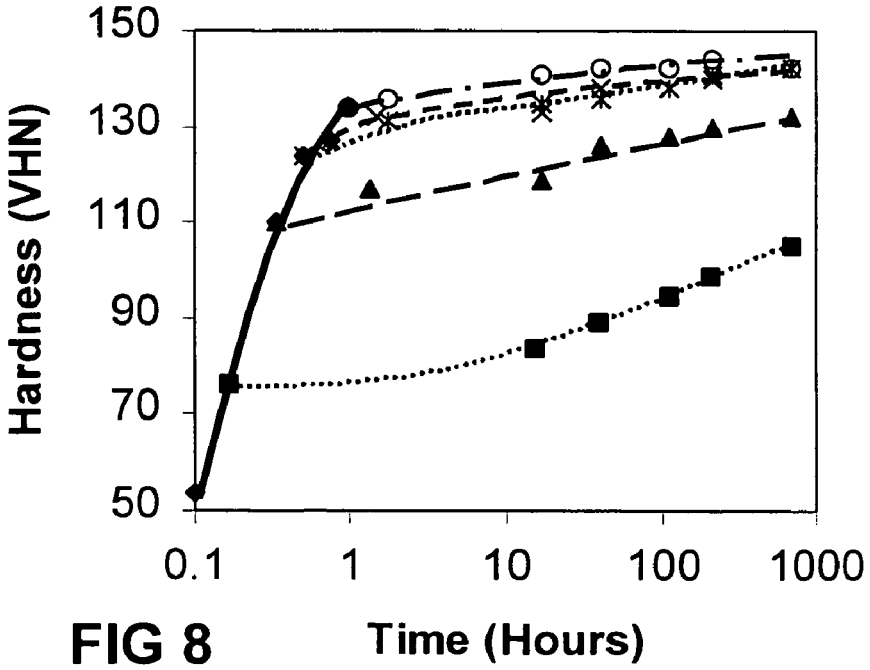
FIG. 8 shows a plot of time against hardness, showing the response in the process of the invention for alloy 6013 (which exhibits substantially similar behaviour to each of alloys 6111 and 6056)

FIG. 8 exhibits the process of the invention as applied to the wrought alloy 6013. In this case, the underaged primary precipitation in stage (a) shown by the solid line was obtained by heating the alloy at 177° C. The stage (c) secondary precipitation was from different initial times and achieved at 65° C. (broken lines). The peak T6 hardness for alloy 6013 is approximately 144 VHN. For alloy 6013 aged during stage (a) for between 30 and 60 minutes, the T6I4 hardness reaches values of 142 VHN in the time frame shown.

The alloy 6013 has similar chemistry to each of alloy 6111 and 6056. While not shown, each of alloy 6111 and alloy 6056 is found to exhibit substantially identical ageing behaviour to that illustrated in FIG. 8 for alloy 6013 and to that shown later herein with reference to FIG. 13 for alloy 6013, resulting in equivalent properties to alloy 6013.

Figure 9:
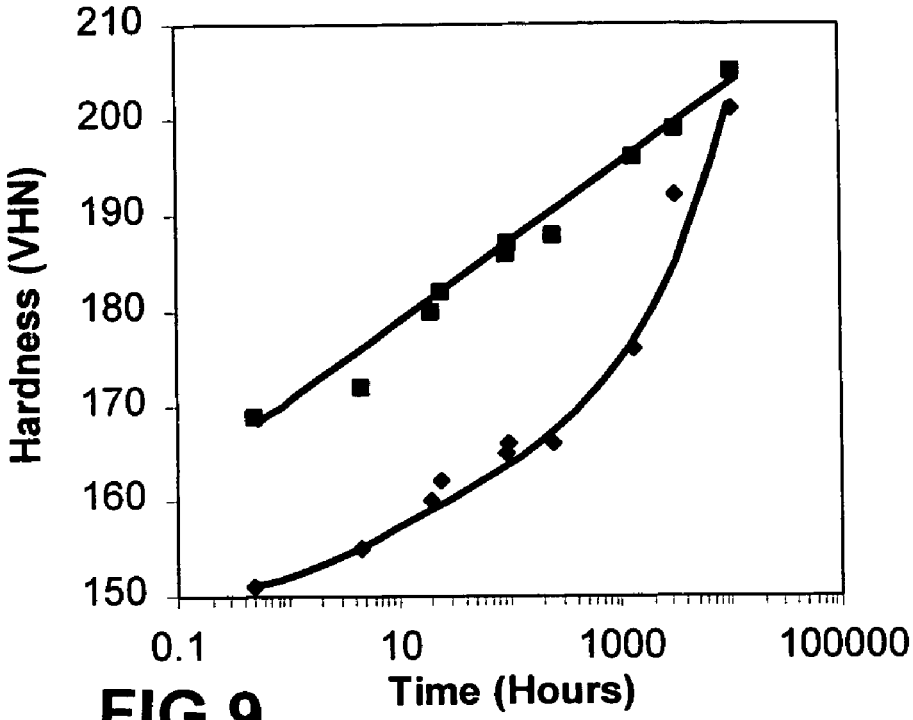
FIG. 9 is a plot of time against hardness, illustrating secondary precipitation response at 25° C. of alloy 7075 and alloy 7075+Ag in application of the process of the invention.

FIG. 9 exhibits T6I4 ageing curves according to the process of the present invention for the (Al—Zn—Mg—Cu) alloy 7075 (diamonds) and the experimental alloy 7075+Ag (squares). In each case, the alloy was initially subjected to stage (a) ageing for 0.5 hours at 130° C., quenched and then stored at 25° C. for stage (c) secondary precipitation for extended times up to and beyond 10,000 hours. Corresponding T6 peak hardness for alloy 7075 is approximately 195 VHN and, for alloy 7075+Ag it is 209 VHN. However, FIG. 9 shows that, with application of the T6I4 process of the invention, the hardnesses continue to rise at such extended times, Over the time interval shown in FIG. 8, the alloy 7075 has exceeded the hardness in the T6 temperature and the alloy 7075+Ag already is approaching the hardness for the T6 temper. The graphs of FIG. 9 highlight the continuing stage (c) secondary precipitation effect, which continues even at times greater than one year.

Alloy 7075 and alloy 7075+Ag were subjected to further heat treatments, similar to those illustrated in FIG. 9, but with stage (c) ageing over extended times at 65° C. rather than 25° C. This is shown in FIG. 10 and the plateau observed at extended times in the hardening curve may be indicative of the maximum hardening obtainable for the alloy, that significantly exceeds those for the T6 temper.

Figure 10:
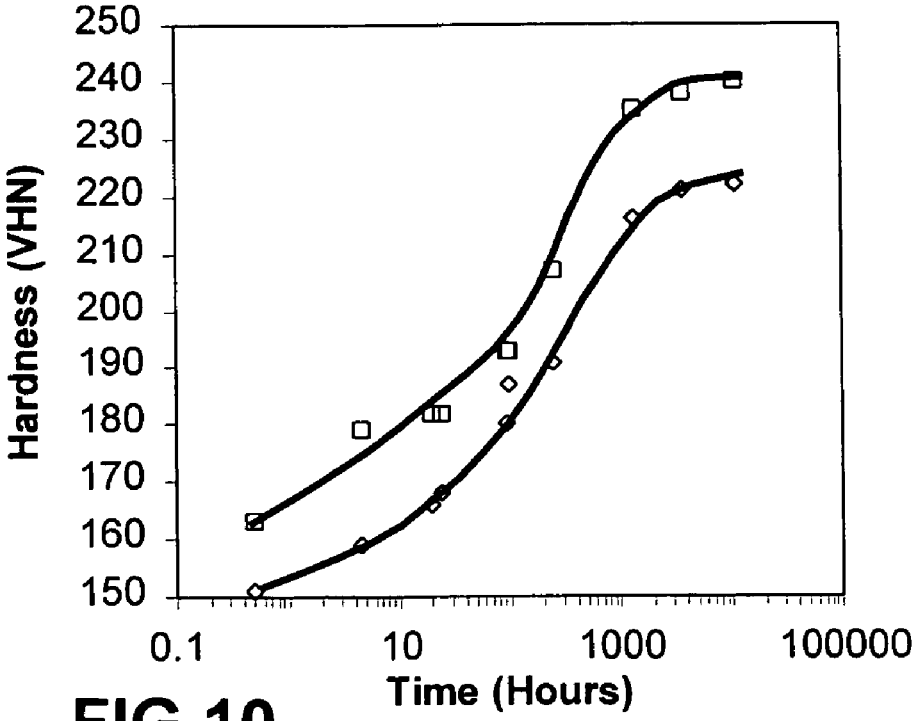
FIG. 10 is a plot of time against hardness, illustrating the secondary response at 65° C. of alloy 7075 and alloy 7075+Ag, in application of the present invention.

FIGS. 9 and 10 also highlight that trace additions of minor elements, such as Ag in this case, may significantly effect the speed and efficacy of secondary precipitation.

FIGS. 9 and 10 also highlight the differences brought about by altering the temperature of the stage (c) hardening. From these Figures, it is readily seen that at equivalent times, the material produced by stage (c) hardening at 25° C. has not achieved the same levels of hardness that have been generated from material that has undergone stage (c) hardening at 65° C.

As indicated by FIG. 10, the hardening that occurs at the reduced temperature may reach a maximum at extended times, that is greater than that of the T6 alloy. It may therefore be expected that for the given conditions of the experiments and process schedules, strengthening eventually plateaus and does not rise further, and may correspond to a complete depletion of solute from solid solution.

Figure 11:
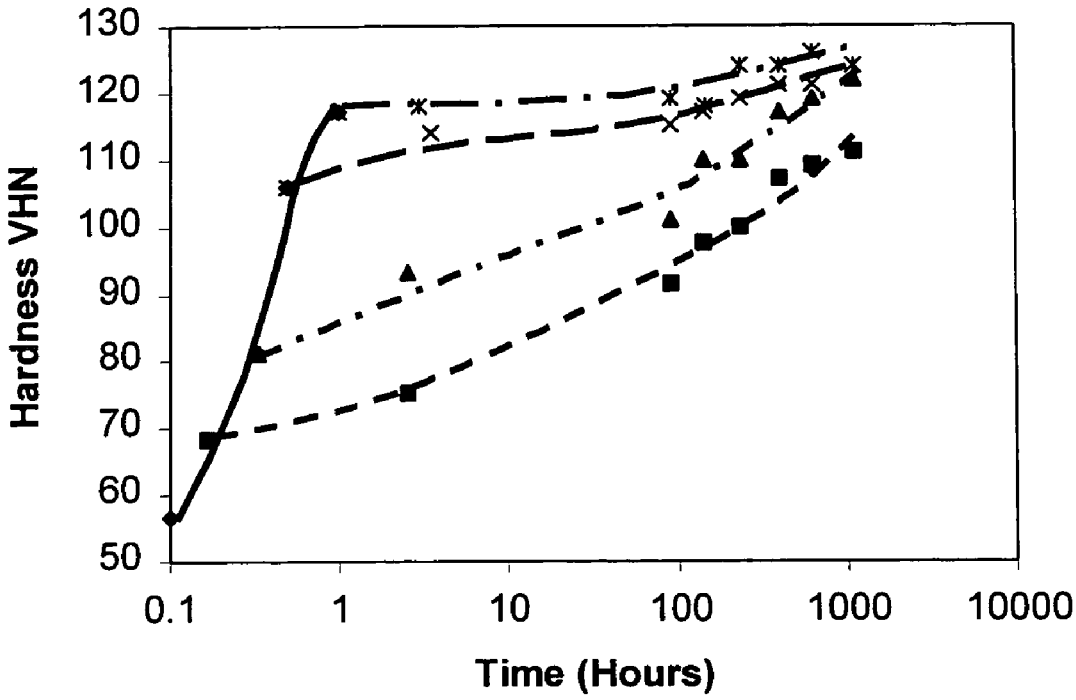
FIG. 11 shows ageing curves for casting alloy 357 aged from different initial times.

FIG. 11 hows ageing curves for casting alloy 357 (Australian designation alloy 601) aged to the T6I4 temper from different initial times in stage (a) at 177° C. Following the stage (b) quench, the alloy was subjected to stage (c) heating at 65° C. At extended times, the curves display a similar trend to those presented in FIGS. 5 and 6. The alloy 357 exhibits ageing under secondary precipitation to eventually approach T6 hardness of 124 VHN and T6 tensile properties. Table 1 sets out tensile properties for alloy 357 resulting from several different ageing treatments.

TABLE 1

Comparative tensile properties of the 357 casting alloy resulting from several different ageing treatments.

| Treatment | Yield Stress | UTS | Elongation to Failure |
|---|---|---|---|
| T6 | 287 MPa | 340 MPa | 7% |
| T6I6 | 327 MPa | 362 MPa | 3% |
| UA40 | 229 MPa | 296 MPa | 9% |
| UA60 | 250 MPa | 312 MPa | 8% |
| UA90 | 261 MPa | 316 MPa | 8% |
| T6I4-40 | 260 MPa | 339 MPa | 8% |
| T6I4-60 | 280 MPa | 347 MPa | 8% |
| T6I4-90 | 281 MPa | 342 MPa | 6% |

In Table 1, the UA treatments represent implementation of stage (a) and (b) of the present invention, without stage (c), in which the alloy 357 was simply heated at 177° C. for 40, 60 or 90 minutes and then quenched to ambient temperature. These treatments are followed by three treatments according to the invention in which the alloy was heated at 177° C. for 40, 60 or 90 minutes, quenched to ambient temperature, and then held for 1 month at 65° C. to achieve property enhancement by secondary precipitation. The T6I6 treatment is one according to the four stage process of our above-mentioned specification PCT/AU00/01601, in which the treatment involved ageing the alloy 357 at 177° C. for 20 minutes, quenching into water, interrupted at 65° C. for a given period, and re-ageing at 150° C.

Table 2 shows the tensile and fracture toughness values for the casting alloy 357 after each of the first three heat treatments of Table 1.

TABLE 2

Tensile properties and Fracture Toughness for 3 different heat treatments (Alloy 357) comparing the properties of T6, T6I6 and T6I4 material.

| Treatment | Yield Stress | UTS | Fracture Toughness |
|---|---|---|---|
| T6 | 287 MPa | 340 MPa | 25.5 MPa$\sqrt{m}$ |
| T6I6 | 327 MPa | 362 MPa | 26 MPa$\sqrt{m}$ |
| T6I4 | 280 MPa | 347 MPa | 35.9 MPa$\sqrt{m}$ |

FIG. 12 exhibits the effect of the stage (b) cooling rate on the subsequent secondary precipitation response for alloy Al-4Cu. FIG. 12 shows the effect of quenching in stage (b) either into an ethylene glycol based quenchant cooled to ~−10° C., or into hot water at 65° C. In FIG. 12, the alloy was first aged 2.5 h at 150° C. prior to secondary ageing conducted at 65° C. The secondary ageing response for the alloy quenched from 150° C. into the cooled quenchant is shown by the broken line and solid triangles. The secondary ageing response for the alloy quenched from 150° C. into water at 65° C. is shown by the solid line and open squares. It is readily noted that the rate at which secondary precipitation then occurs is much higher for the fastest cooled material.

FIG. 13 is as for FIG. 12, but for the alloy 6013. In this instance, the alloy was first aged 20 minutes at 177° C. prior to quenching and subsequent exposure at 65° C. The secondary ageing response for the alloy quenched from 177° C. into the cooled ethylene glycol based quenchant is shown by the broken line and solid triangles. The secondary ageing response for the alloy quenched from 177° C. into water at 65° C. is shown by the solid line and open squares. In this alloy, there is little difference in the secondary ageing response for the two conditions examined, except at the greatest times of exposure at 65° C. As indicated above, each of alloy 6111 and alloy 6056 exhibit substantially identical behaviour to that shown in FIG. 13 for alloy 6013.

FIG. 14 is as for FIG. 12, but for the alloy 7075. In this instance, the alloy was first aged 30 minutes at 130° C. prior to quenching and subsequent exposure at 65° C. The secondary ageing response for the alloy quenched from 130° C. into the cooled ethylene glycol based quenchant is shown by the broken line and solid triangles. The secondary ageing response for the alloy quenched from 130° C. into water at 65° C. is shown by the solid line and open squares. In this alloy, the only difference of significance is that the initial hardness value after cooling in hot water is slightly higher than for the alloy cooled by quenching into the quenchant cooled to ~−10° C. Otherwise, there is little difference in the rate of secondary ageing for the two conditions examined.

FIG. 15 also is as for FIG. 12, but for the alloy 8090. In this instance, the alloy was first aged 7.5 h at 185° C. prior to quenching and subsequent exposure at 65° C. The secondary ageing response for the alloy quenched from 185° C. into the cooled ethylene glycol based quenchant is shown by the broken line and solid triangles. The secondary ageing response for the alloy quenched from 185° C. into water at 65° C. is shown by the solid line and open squares. The sample cooled in the cooled quenchant at ~−10° C. exhibits an initial hardness value higher than that of the alloy cooled from 185° C. into water at 65° C. However, its subsequent rate of secondary precipitation is moderately slower than for the more slowly cooled sample. However, after extended durations at 65° C., the two lines converge and the more rapidly cooled material exceeds the hardness values for the sample cooled into water at 65° C., but only at longer durations.

Table 3 shows examples of the tensile properties for the wrought alloys 7050, 2214 (var.2014), 2001, 6111, 6061 and experimental Al-5.6 Cu-0.45 Mg-0.45 Ag alloy, after each of the T6 and T6I4 heat treatments, as an example of how differences apply for different alloys in application. Here it can be noted that for the alloy 7050, the T6I4 temper has a slight reduction in yield stress, but little change to the UTS or strain or failure. Alloy 2214 displays a slight reduction in yield stress, with a slight increase in UTS and strain at failure. However, the time spent at 177° C. for ageing to the T6 condition ranges from 7 to 16 h (in this instance, 16 h), whereas the time spent at 177° C. for ageing to the T6I4 condition was 40 minutes, followed by a reduced temperature dwell period to develop full properties. Alloy 2001 displays similar behaviour to the 2214 alloy, but there is a greater increase in both the UTS and strain at failure for this condition. The experimental Al-5.6Cu-0.45Mg-0.45Ag alloy exhibits little change to the yield stress, but an increase in the UTS and a decrease in the strain at failure. Alloy 6111 exhibits little difference in the tensile properties of the two conditions and is also representative of the alloys 6013 and 6056. However, as for alloy 2214, the typical time for T6 ageing and generation of properties in alloy 6111 at 177° C. is 16 h, whereas the typical time spent at 177° C. for stage (a) of T6I4 ageing is 40 minutes to 1 h. Alloy 6061 displays an improvement in yield stress, UTS and strain to failure, with similar process schedules to those detailed above for alloy 6111. These are examples of how the process may affect tensile properties of differing alloys treated to the T6I4 temper.

TABLE 3

Tensile Properties for Alloys Given The T6I4 Temper or the T6 Temper.

| Alloy | Treatment | Yield Stress | UTS | % Strain at Failure |
|---|---|---|---|---|
| 7050 | T6 | 546 MPa | 621 MPa | 14% |
| 7050 | T6I4 | 527 MPa | 626 MPa | 16% |
| 2214 | T6 | 386 MPa | 446 MPa | 14% |
| 2214 | T6I4 | 371 MPa | 453 MPa | 13% |
| 2001 | T6 | 265 MPa | 376 MPa | 14% |
| 2001 | T6I4 | 260 MPa | 420 MPa | 23% |
| Al—Cu—Mg—Ag | T6 | 442 MPa | 481 MPa | 12% |
| Al—Cu—Mg—Ag | T6I4 | 443 MPa | 503 MPa | 8% |
| 6111 | T6 | 339 MPa | 406 MPa | 13% |
| 6111 | T6I4 | 330 MPa | 411 MPa | 14% |
| 6061 | T6 | 267 MPa | 318 MPa | 13% |
| 6061 | T6I4 | 302 MPa | 341 MPa | 16% |

Table 4 shows examples of the fracture toughness determined in the S-L orientation for each of the alloys listed therein. For alloys listed (except 8090), their corresponding tensile properties are shown in Table 3. Alloy 7050 exhibits a significant improvement (38%) in the fracture toughness over that of the T6 case. The fracture toughness of the 2001, 2214, and 8090 alloys listed is little changed by the T6I4 temper, except where Ag is added, as is the case for the experimental Al-5.6Cu-0.45Mg-0.45Ag alloy, that shows a 20% increase in fracture toughness. For the alloy 6061, the fracture toughness is increased 17% with the T6I4 temper over the T6 temper.

TABLE 4

Fracture Toughness in the S-L orientation* for Alloys Given The T6I4 Temper or the T6 Temper.

| Alloy | Treatment | Fracture Toughness (S-L) |
|---|---|---|
| 7050 | T6 | 37.6 MPa$\sqrt{m}$ |
| 7050 | T6I4 | 52 MPa$\sqrt{m}$ |
| 2214 | T6 | 26.9 MPa$\sqrt{m}$ |
| 2214 | T6I4 | 27.1 MPa$\sqrt{m}$ |
| 2001 | T6 | 56.8 MPa$\sqrt{m}$ |
| 2001 | T6I4 | 56.9 MPa$\sqrt{m}$ |
| Al—Cu—Mg—Ag | T6 | 23.4 MPa$\sqrt{m}$ |
| Al—Cu—Mg—Ag | T6I4 | 28.08 MPa$\sqrt{m}$ |
| 8090 | T6 | 24.2 MPa$\sqrt{m}$ |
| 8090 | T6I4 | 25.7 MPa$\sqrt{m}$ |
| 6061 | T6 | 36.8 MPa$\sqrt{m}$ |
| 6061 | T6I4 | 43.2 MPa$\sqrt{m}$ |

*Note all tests conducted in S-L orientation on samples tested according to ASTM standard E1304-89, "Standard Test Method for Plane Strain (Chevron Notch) Fracture Toughness of Metallic Materials.

As will be appreciated, the hardness curves shown in various Figures are in accordance with established procedures. That is, they are based on samples of selected alloys which are treated for respective times and then quenched for hardness testing. This applies to hardness curves for conventional heat treatments such as T6 and T8. It also applies to stage (a) and stage (c) treatments in accordance with the present invention. Also, while not detailed in each case, a suitable solution treatment is implicit in all instances, as is quenching following solution treatment to retain solute elements in solid solution. While alternatives are detailed herein, all alloys were subjected to a suitable solution treatment and quench, prior to being subjected to a conventional heat treatment or a heat treatment in accordance with the invention, with the quench generally being to ambient temperature or below for convenience. Also, where alloys were subjected to a stage (a) and then a stage (c) treatment in accordance with the invention, an intervening stage (b) quench is implicit and, except where otherwise indicated, the stage (b) quench was to ambient temperature or below.

Finally, it is to be understood that various alterations, modifications and/or additions may be introduced into the constructions and arrangements of parts previously described without departing from the spirit or ambit of the invention.

The invention claimed is:

1. A process for the ageing heat treatment of an age-hardenable aluminium alloy, wherein the process includes the preliminary step of selecting an age hardenable aluminum alloy which has been solution heat treated and quenched to retain alloying elements in solid solution, and wherein the process further includes the stages of:

(a) artificially ageing the alloy by holding the alloy at an elevated ageing temperature which is appropriate for a T6 temper for the alloy, for a period of time which is shorter than the time for a full T6 temper at said temperature for thereby ageing the alloy to promote precipitation of at least one solute element, wherein said period of time produces underaged alloy having not less then 40% and not more than 85% of the maximum hardness and strength obtainable from said full T6 temper;

(b) quenching the underaged alloy, in a suitable fluid medium, from the ageing temperature for stage (a) to cool the underaged alloy at a sufficiently rapid rate and to a sufficiently low temperature of from −10° C. to 65° C. thereby to substantially arrest the precipitation; and (c) exposing the quenched alloy produced by stage (b) to an ageing temperature, lower than the ageing temperature of stage (a) and not exceeding 90° C. so as to develop adequate mechanical properties as a function of time, by a secondary precipitation comprising further solute element precipitation.

2. The process of claim 1, wherein the temperature and period of time for stage (a) are such as to achieve under-ageing providing not more than 40% to 75% of the maximum tensile strength obtainable from the full T6 temper.

3. The process of claim 1, wherein the lower temperature to which the underaged alloy is cooled in stage (b) is substantially ambient temperature.

4. The process of claim 1, wherein the lower temperature to which the underaged alloy is cooled in stage (b) is substantially the ageing temperature required for stage (c).

5. The process of claim 1, wherein the quenching stage (b) is conducted using a quenching medium comprising a fluid or fluidised bed.

6. The process of claim 1, wherein the quenching stage (b) is conducted using a quenching medium comprising water or a polymer based quenchant.

7. The process of claim 1, wherein the ageing temperature for stage (c) is within the range of about 20° C. to about 90° C.

8. The process of claim 1, wherein the ageing temperature for stage (c) is ambient temperature.

9. The process of claim 1, wherein the process further includes, prior to stage (a), the steps of:

(i) heating the alloy to a solution treatment temperature for a period of time sufficient to take solute elements of the alloy into solid solution, and (ii) quenching the alloy from the solution treatment temperature to thereby retain the alloy elements in solid solution.

10. The process of claim 9, wherein the quenching step (ii) cools the alloy from the solution treatment temperature to a temperature below the ageing temperature for stage (a).

11. The process of claim 9, wherein the quenching step (ii) cools the alloy from the solution treatment temperature substantially to the ageing temperature for stage (a).

12. The process of claim 9, wherein the alloy is subjected to mechanical deformation before stage (a).

13. The process of claim 9, wherein the alloy is subjected to mechanical deformation between step (i) and stage (a).

14. The process of claim 13, wherein the mechanical deformation occurs during step (ii).

15. The process of claim 13, wherein the alloy is subjected to mechanical deformation between step (ii) and stage (a).

16. The process of claim 1, wherein the alloy is subjected to mechanical deformation between stage (b) and stage (c).

17. The process of claim 1, wherein the alloy is subjected to mechanical deformation during stage (c).

18. The process of claim 1, wherein the period of time at the ageing temperature for stage (a) is from several minutes to 8 hours.

19. The process of claim 1, wherein the period of time at the ageing temperature for stage (a) is in excess of 8 hours, but less than the time required to reach full strengthening.

20. The process of claim 1, wherein stage (c) is conducted for a period of time which, at the ageing temperature for stage (c), achieves substantially complete secondary precipitation.

21. The process of claim 1, wherein stage (c) is conducted for a period of time which, at the ageing temperature for stage (c), achieves a required level of strengthening of the alloy beyond that attained directly after stage (b).

22. The process of claim 1, wherein the period of time for stage (c) achieves a level of fracture toughness which is at least equal to that obtainable with the full T6 temper.

23. The process of claim 1, wherein a period of time for stage (c) achieves a level of tensile properties which is at least comparable to the level obtainable with the full T6 temper.

* * * * *